US009452911B1

(12) United States Patent
Tipton

(10) Patent No.: US 9,452,911 B1
(45) Date of Patent: Sep. 27, 2016

(54) ADJUSTABLE FIXTURE FOR HOLDING A PART ON A HOIST/CRANE

(71) Applicant: Michael J. Tipton, Rocky Mount, VA (US)

(72) Inventor: Michael J. Tipton, Rocky Mount, VA (US)

( * ) Notice: Subject to any disclaimer, the term of this patent is extended or adjusted under 35 U.S.C. 154(b) by 0 days.

(21) Appl. No.: 14/824,977

(22) Filed: Aug. 12, 2015

(51) Int. Cl.
*B66C 23/48* (2006.01)
*B66C 1/22* (2006.01)

(52) U.S. Cl.
CPC *B66C 1/22* (2013.01); *B66C 23/48* (2013.01)

(58) Field of Classification Search
CPC ..... B25H 1/0007; B25H 5/00; B66C 1/16; B66C 1/22; B66C 23/48; B66C 23/485
USPC ..... 294/67.1, 67.4, 67.5; 254/8 B; 212/257; 280/32.6
See application file for complete search history.

(56) References Cited

U.S. PATENT DOCUMENTS 2,011,766 A 8/1935 Johnston
2,838,278 A * 6/1958 Tarbet ..... B66F 5/04 248/178.1
2,901,218 A 8/1959 Scott
3,059,784 A 10/1962 Chamberlain et al.
3,365,026 A 1/1968 Mancini
3,559,981 A * 2/1971 Abshear ..... B60S 5/00 254/134
3,628,772 A * 12/1971 Gaarder ..... B66F 13/00 254/134
3,773,293 A * 11/1973 Arnes ..... B66F 3/36 254/134
4,118,010 A * 10/1978 Hanscom ..... B66C 23/48 254/124
4,526,345 A 7/1985 Schmidt
5,203,540 A * 4/1993 Lee ..... B25H 1/0007 254/124
6,109,593 A * 8/2000 Craychee ..... B66F 3/36 254/131
6,120,236 A * 9/2000 Smith ..... B25H 1/0007 414/589
6,457,700 B1 * 10/2002 Hong ..... B66C 23/48 254/124
6,641,146 B2 11/2003 Reese
7,080,823 B1 * 7/2006 Triplett ..... B66C 1/107 254/8 B
2007/0151880 A1 7/2007 Chapman et al.

* cited by examiner

*Primary Examiner* — Dean Kramer
(74) *Attorney, Agent, or Firm* — Richard L. Miller

(57) ABSTRACT

An angularly adjustable and reversible saddle that replaceably, angularly, and reversibly attaches to a ground-based hoist including a boom having a free distal end with a lateral through bore, and replaceably supports a component. For example, when applied to the automotive industry, the ground-based hoist can be a motor hoist and the component can be any component requiring positioning from below the automobile, such as, a transmission, a gas tank, a rear end, etc. The angularly adjustable and reversible saddle includes a receiver and a mounting apparatus. The receiver replaceably supports the component. The mounting apparatus depends from the receiver and replaceably, angularly adjustably, and reversibly attaches to the ground-based hoist via the lateral through bore of the free distal end of the boom of the ground-based hoist.

55 Claims, 8 Drawing Sheets

ADJUSTABLE FIXTURE FOR HOLDING A PART ON A HOIST/CRANE

BACKGROUND OF THE INVENTION

1. Field of the Invention

The present invention relates to an adjustable fixture, and more particularly, an adjustable fixture for holding a part on a hoist/crane.

2. Description of the Prior Art

Numerous innovations for hoist/lift/jack-related devices have been provided in the prior art that will be described. Even though these innovations may be suitable for the specific individual purposes to which they address, however, they differ from the present invention.

A FIRST EXAMPLE, U.S. Pat. No. 2,011,766, Issued on Aug. 20, 1935, to Johnston teaches a an automobile lift of the "roll on" class and having a trough-shaped wheel-supporting member. A wheel-engaging plate is mounted above the wheel-supporting member of the lift, and legs for the wheel-engaging plate is extended downwardly and of a length as to engage a floor and thereby hold the wheel-supporting plate elevated above the wheel-supporting member when the lift is in a lowered position thereof.

A SECOND EXAMPLE, U.S. Pat. No. 2,901,218, Issued on Aug. 25, 1959, to Scott teaches a transmission hoist for a vehicle including seat having a backrest and a dashboard. The transmission hoist includes a first horizontally disposed beam U-shaped in cross section adapted to extend between the backrest of the seat of the vehicle and the dashboard of the vehicle, a U-shaped second beam arranged in spaced and parallel relation with respect to the first beam and positioned therebelow, a first pair of spaced, parallel, and vertically disposed bars extending between the first beam and the second beam and secured thereto, a second pair of spaced, parallel, and vertically disposed bars extending between the first beam and the second beam and secured thereto, a bracket extending upwardly from the second beam and secured thereto, a winch mounted on the bracket, a crank for operating the winch, a cable arranged in engagement with the winch, a pulley journaled in an end of the second beam and having the cable trained thereover, a block and tackle depending from the second beam and connected to the cable, a hook depending from the block and tackle, and a line arranged in engagement with the hook and adapted to engage the transmission being handled.

A THIRD EXAMPLE, U.S. Pat. No. 3,059,784, Issued on Oct. 23, 1962, to Chamberlain, et al. teaches a one-man operable outboard engine carrier including a dolly having a horizontal frame and apparatus for supporting the frame on the ground in a stable horizontal position while permitting travel of the frame over the ground, a hand cart having wheels at its lower end and a handle at its upper end and having supporting apparatus intermediate the ends on which an outboard marine engine is mounted and to which it is secured, and an apparatus mounting the hand cart on the dolly wholly out of contact with the grounds. The apparatus provides for pivotal movement of the cart between substantially vertical and horizontal positions about a horizontal axis located intermediate the upper and lower ends of the hand cart and for swinging movement of the hand cart about a vertical axis with respect to the horizontal frame and while the frame remains stationary. The cart has a frame that is disposed wholly above the horizontal frame of the dolly when the cart is in vertical position. The apparatus includes a separable connection enabling the cart to be wholly removed from the dolly for transportation of the engine over the ground independently of the dolly.

A FOURTH EXAMPLE, U.S. Pat. No. 3,365,026, Issued on Jan. 23, 1968, to Mancini teaches an auto transmission jack for an auto lift to support the transmission when released from the auto and permit dropping of the lift and jack until the jack is supported upon the floor on wheels to permit moving the jack and supported transmission away from the lift for repair and re-installing the repaired transmission in the same manner.

A FIFTH EXAMPLE, U.S. Pat. No. 3,773,293, Issued on Nov. 20, 1973, to Arnes teaches a saddle for jacks handling car transmissions in confined spaces beneath the vehicle. The saddle has a rectangular plate with four arms slidable transversely to its edges. Upstanding blades are provided on the arms for supporting the load. The arms are secured in their adjusted position by bolt-and-slot connections.

A SIXTH EXAMPLE, U.S. Pat. No. 4,526,345, Issued on Jul. 2, 1985, to Schmidt teaches a double lift jack employing a first hydraulic jack having a long and high-speed lift to elevate a platant into an operating position, and a second hydraulic jack mounted on the platant having a short and low-speed lift. The two jacks and the platant are mounted in a sturdy and open-topped housing. The long-lift jack is employed to rapidly elevate the platant, and the short-lift jack into their operating positions. The platant is thereupon affixed to the housing in the extended position using studs that are passed through a lip on the housing as the platant is elevated. A load base is raised and lowered by operation of the short-lift jack. The load base is stabilized by hardened guide rods that pass through guide holes in the platant. The thus-locked platant provides a stable base and precise guidance for positioning of a load mounted on the load base. When the studs are released and the long-lift jack is retracted, the load base is rapidly cleared from interference with a load. An hydraulic control system for the two jacks requires that the long-lift jack receive pressurized hydraulic fluid before permitting actuation of the short-lift jack in order to ensure that the platant is urged into its secured position in contact with the lip of the housing whenever the load base is raised or lowered.

A SEVENTH EXAMPLE, U.S. Pat. No. 6,641,146, Issued on Nov. 4, 2003, to Reese teaches a creeper having a base originally used for an engine hoist. The base has wheels for easy mobility. The base in its original form looks like an A-shape when viewed from above. Alternatively, the base is modified to accommodate a tilt front end vehicle, such as, a tractor trailer truck. The height adjuster is an extendable/retractable device, such as, an hydraulic cylinder. A support beam connects the base to a platform. A vertical arm support that is, preferably, metal keeps the height adjuster in proper alignment for the range of movement of the platform. The platform has a frame. Although the frame is any number of pieces, it is two pieces in this embodiment. The two pieces include a body section and a chest board section connected by a pivot plate. The entire platform is folded down for easy storage. Each section is, preferably, padded with a body pad and a chest pad, respectively. There are, preferably, three platform pivot points including a first pivot point that attaches the platform to the support beam, a second pivot point where the height adjuster is mounted, and a third pivot point between the chest board and the body board.

AN EIGHTH EXAMPLE, U.S. Pat. No. 2007/0151880, Published on Jul. 5, 2007, to Chapman, et al. teaches a stabilizer to aid in the installation and removal of transmissions from vehicles, which is a receptacle with a bottom and a sidewall. The sidewall is shaped, and of sufficient strength, to support the underside of the transmission while the bottom is flat so as to rest in a stable manner on the lift platform of a hydraulic jack. The stabilizer allows one person to remove a transmission from a vehicle for repair then re-install the transmission when repaired.

It is apparent now that numerous innovations for hoist/lift/jack-related devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an adjustable fixture for holding a part on a hoist/crane that avoids the disadvantages of the prior art.

ANOTHER OBJECT of the present invention is to provide an adjustable fixture for holding a part on a hoist/crane that is simple and inexpensive to manufacture.

STILL ANOTHER OBJECT of the present invention is to provide an adjustable fixture for holding a part on a hoist/crane that is simple to use.

BRIEFLY STATED, STILL YET ANOTHER OBJECT of the present invention is to provide an angularly adjustable and reversible saddle that replaceably, angularly, and reversibly attaches to a ground-based hoist including a boom having a free distal end with a lateral through bore, and replaceably supports a component. For example, when applied to the automotive industry, the ground-based hoist can be a motor hoist and the component can be any component requiring positioning from below the automobile, such as, a transmission, a gas tank, a rear end, etc. The angularly adjustable and reversible saddle includes a receiver and a mounting apparatus. The receiver replaceably supports the component. The mounting apparatus depends from the receiver and replaceably, angularly adjustably, and reversibly attaches to the ground-based hoist via the lateral through bore of the free distal end of the boom of the ground-based hoist.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Introductory

Figure 1:
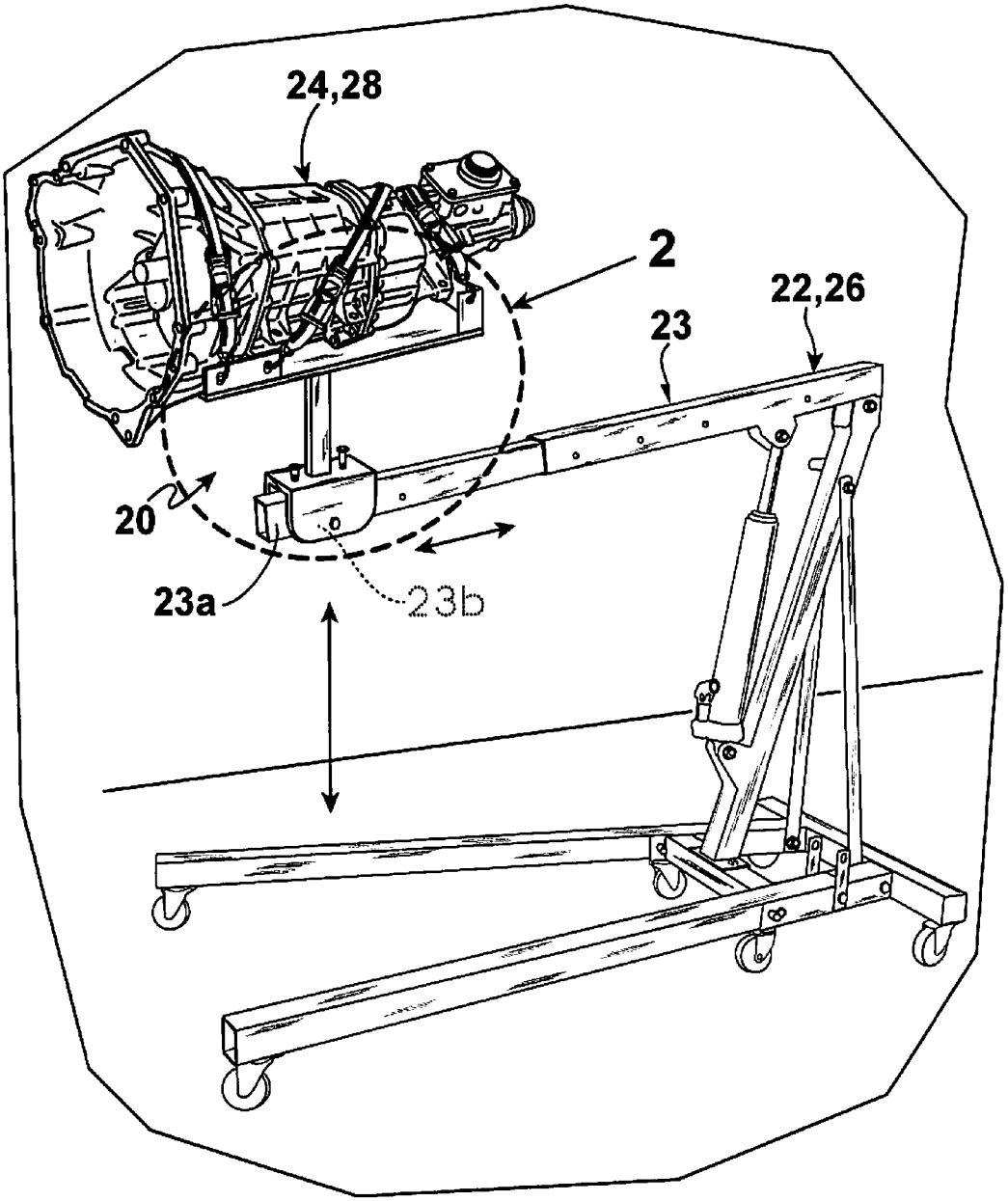
FIG. 1 is a diagrammatic perspective view illustrating an adjustable fixture for holding a part on a hoist/crane installed on a typical shop hoist/crane.
Figure 2:
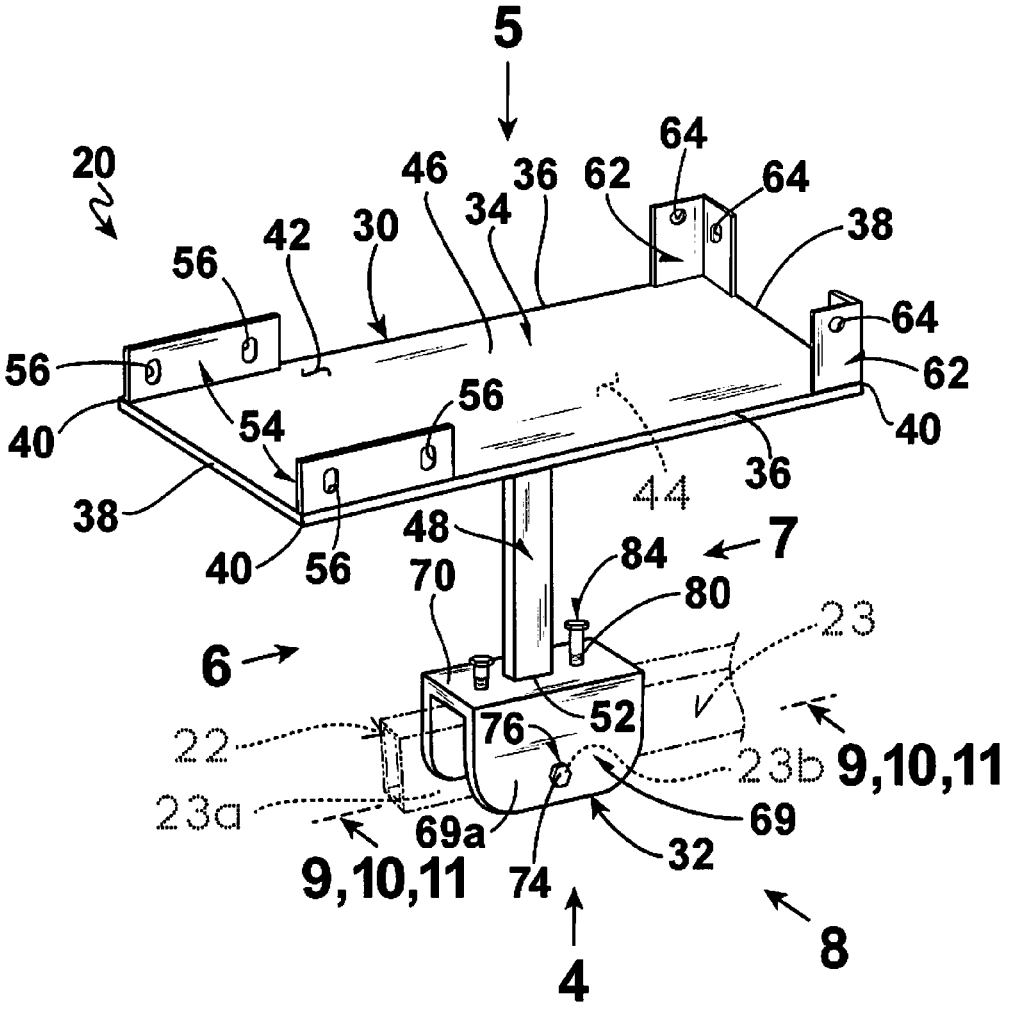
FIG. 2 is a diagrammatic perspective view, of an area enclosed in the dotted curve indicated by arrow 2 in FIG. 1, illustrating the adjustable fixture for holding a part on a hoist/crane per se.
Figure 3:
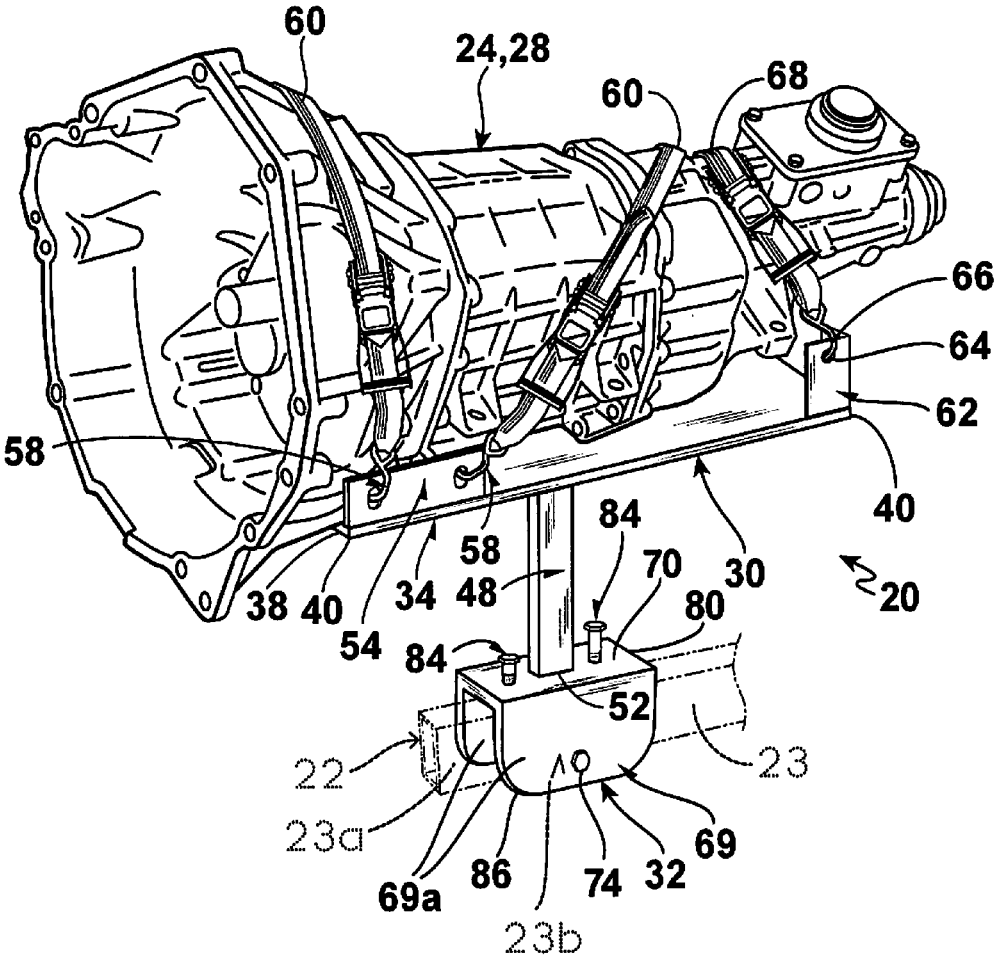
FIG. 3 is a diagrammatic perspective view illustrating the adjustable fixture for holding a part on a hoist/crane with a typical part/transmission secured by ratchet straps thereon.
Figure 4:
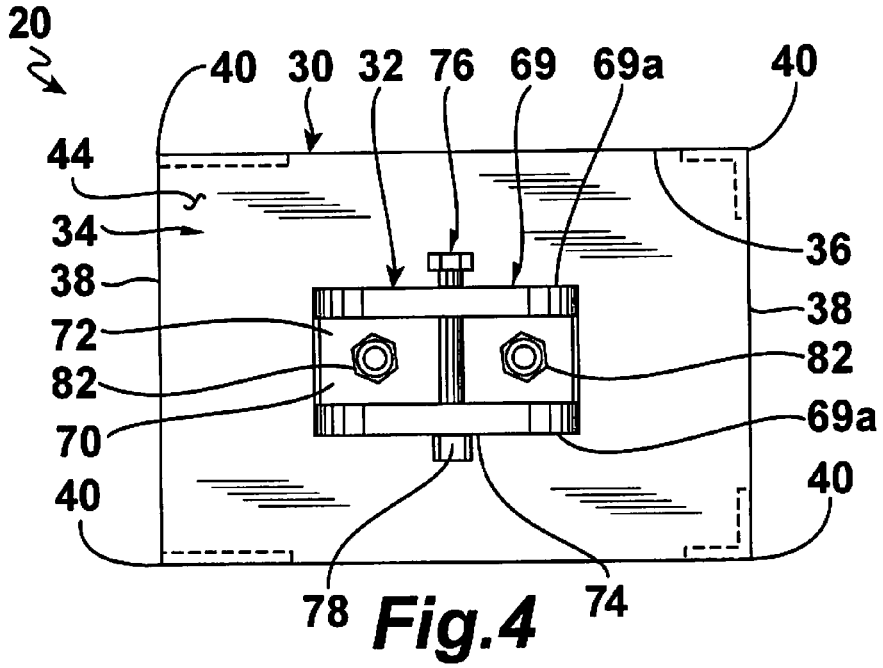
FIG. 4 is a bottom plan view of the fixture per se, taken in the direction of arrow 4 in FIG. 2.
Figure 5:
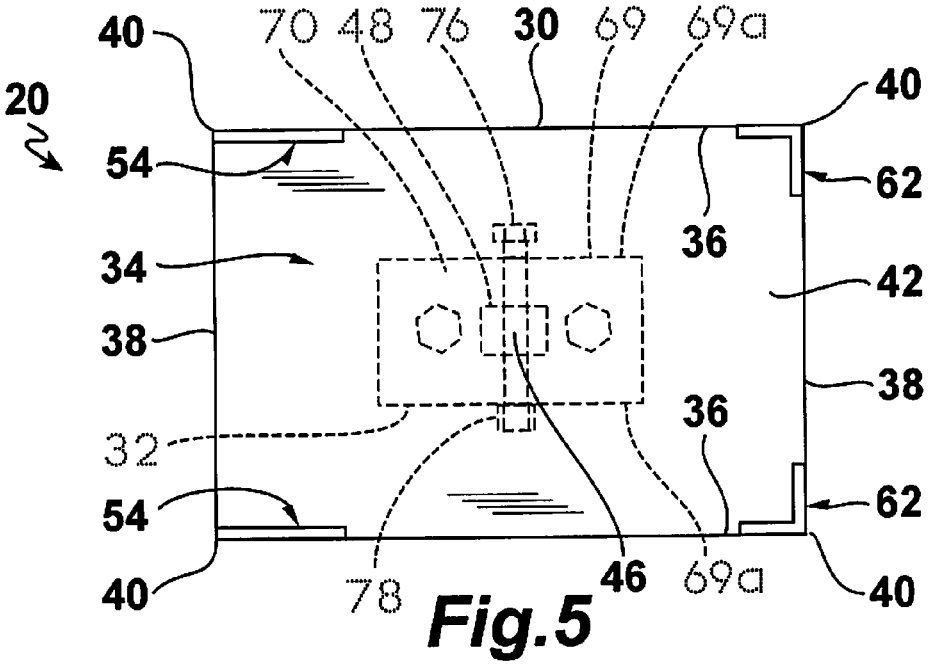
FIG. 5 is a top plan view of the fixture per se, taken in the direction of arrow 5 in FIG. 2.
Figure 6:
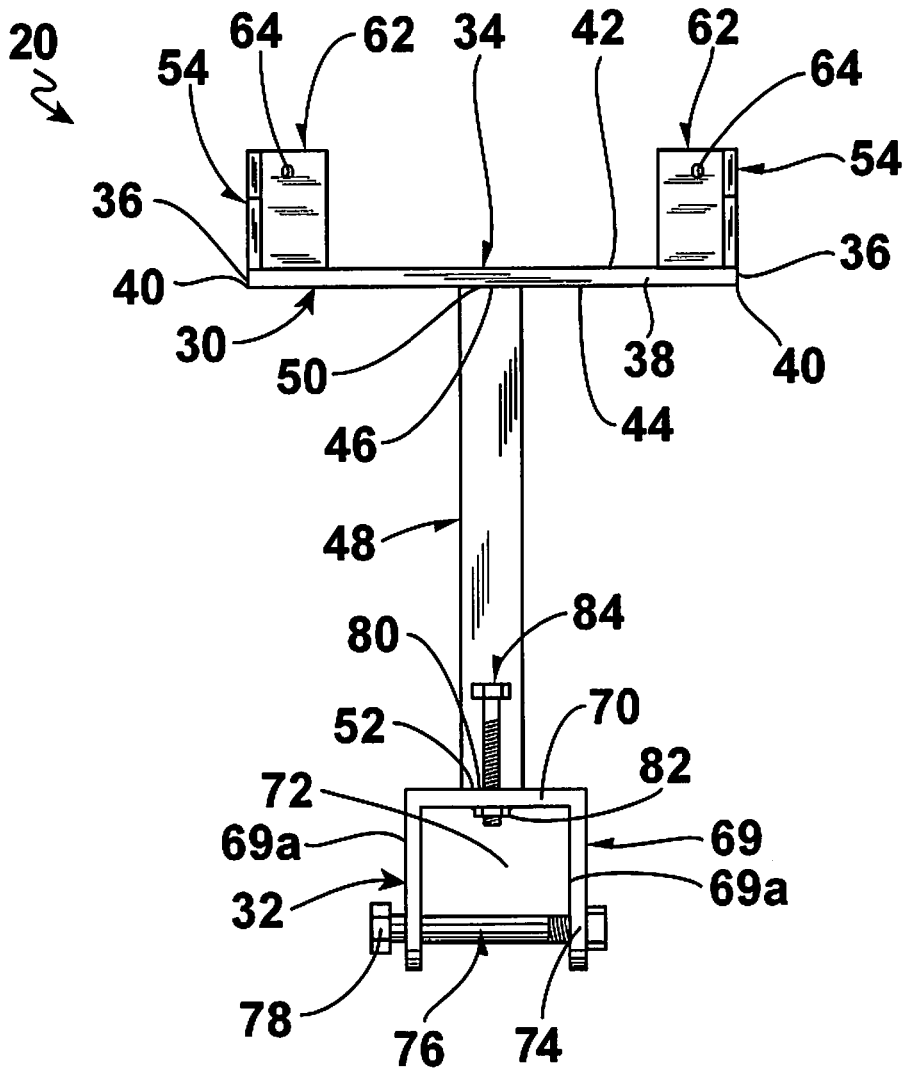
FIG. 6 is a front elevational view of the fixture per se, taken in the direction of arrow 6 in FIG. 2.
Figure 7:
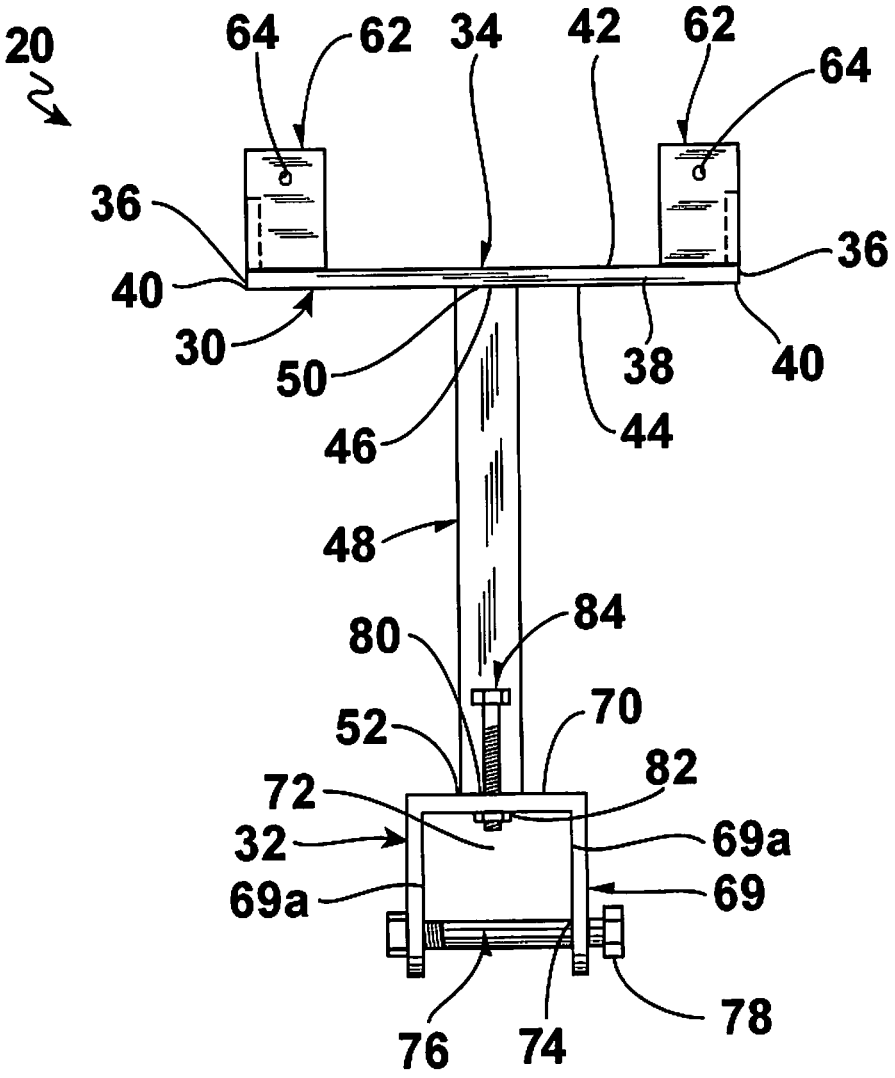
FIG. 7 is a rear elevational view of the fixture per se, taken in the direction of arrow 7 in FIG. 2.
Figure 8:
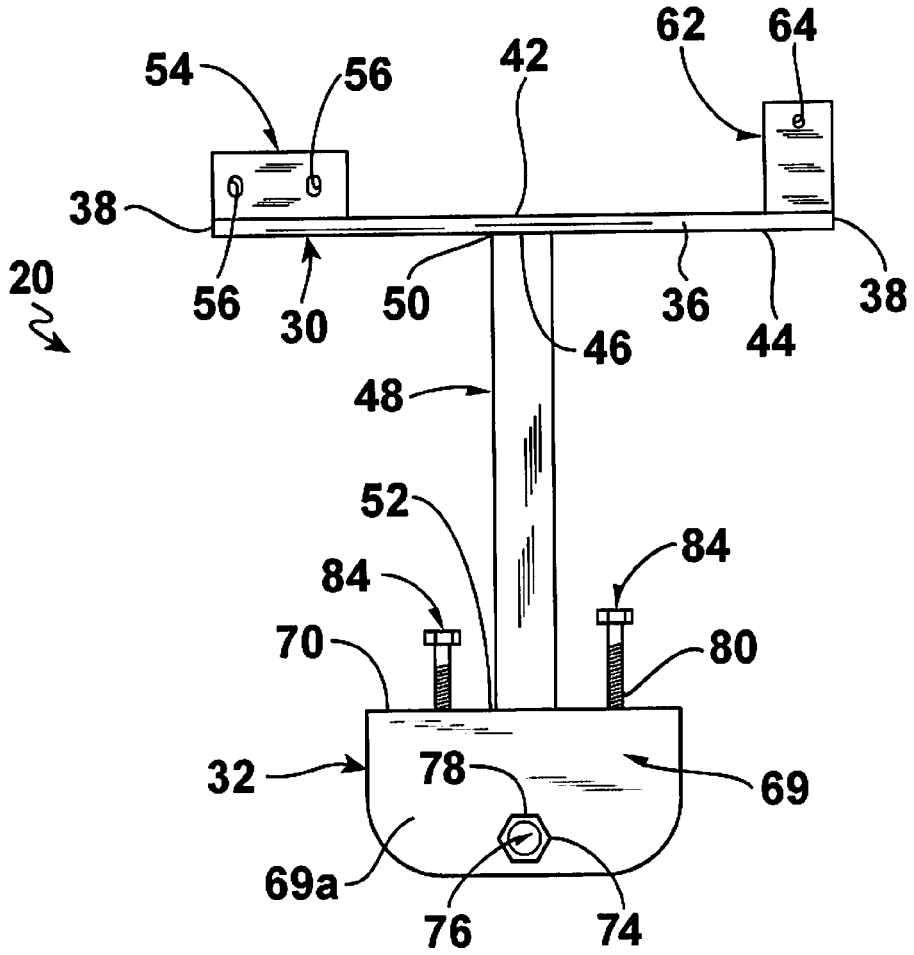
FIG. 8 is a left side elevational view of the fixture per se, taken in the direction of arrow 8 in FIG. 2.

20 angularly adjustable and reversible saddle of embodiments of present invention for replaceably, angularly, and reversibly attaching to ground-based hoist 22 via lateral through bore 23*b* of free distal end 23*a* of boom 23 of ground-based hoist 22 and for replaceably supporting component 24
22 ground-based hoist
23 boom of ground-based hoist 22
23*a* free distal end of boom 23 of ground-based hoist 22
23*b* lateral through bore of free distal end 23*a* of boom 23 of ground-based hoist 22
24 component
26 motor hoist of ground-based hoist 22
28 transmission of component 24

Overall Configuration of Angularly Adjustable and Reversible Saddle 20

30 receiver for replaceably supporting component 24
32 mounting apparatus for replaceably, angularly, and reversibly attaching to ground-based hoist 22

Specific Configuration of Receiver 30

34 base plate of receiver 30
36 pair of long edges of base plate 34 of receiver 30
38 pair of short edges of base plate 34 of receiver 30
40 two pair of right-angled corners of base plate 34 of receiver 30
42 upper surface of base plate 34 of receiver 30
44 lower surface of base plate 34 of receiver 30
46 center of base plate 34 of receiver 30
48 pedestal of receiver 30
50 proximal end of pedestal 48 of receiver 30
52 distal end of pedestal 48 of receiver 30
54 first pair of uprights of receiver 30
56 pair of lateral through bores of each first upright of pair of first uprights 54 of receiver 30 for replaceably receiving two hooks 58 of two bungee cords 60, respectively
58 two hooks of two bungee cords 60, respectively
60 two bungee cords for replaceably holding component 24 to base plate 34 of receiver 30
62 second pair of uprights of receiver 30
64 pair of lateral through bores of each second upright of pair of second uprights 62 of receiver 30 for replaceably receiving additional hook 66 of additional bungee cord 68 for further replaceably holding component 24 to base plate 34 of receiver 30
66 additional hook of additional bungee cord 68

68 additional bungee cord for further replaceably holding component 24 to base plate 34 of receiver 30

Specific Configuration of Mounting Apparatus 32

69 yoke of mounting apparatus 32
69*a* pair of flanges of yoke 69 of mounting apparatus 32
70 web of yoke 69 of mounting apparatus 32
72 space of yoke 69 of mounting apparatus 32 for receiving free distal end 23*a* of boom 23 of ground-based hoist 22
74 pair of lateral through bores of pair of flanges 69*a* of yoke 69 of mounting apparatus 32, respectively, for being aligned with lateral through bore 23*b* of free distal end 23*a* of boom 23 of ground-based hoist 22
76 mounting bolt of mounting apparatus 32 for passing through lateral through bore 23*b* of free distal end 23*a* of boom 23 of ground-based hoist 22
78 nut of mounting apparatus 32
80 pair of through bores of web 70 of yoke 69 of mounting apparatus 32
82 pair of nuts of web 70 of yoke 69 of mounting apparatus 32
84 pair of adjusting bolts of mounting apparatus 32

DETAILED DESCRIPTION OF THE PREFERRED EMBODIMENT

Introductory

Referring now to the figures, in which like numerals indicate like parts, and particularly to FIG. 1, the angularly adjustable and reversible saddle of the embodiments of the present invention is shown generally at 20 for replaceably, angularly, and reversibly attaching to a ground-based hoist 22 including a boom 22 having a free distal end 23*a* with a lateral through bore 23*b*, and for replaceably supporting a component 24.

For example, when applied to the automotive industry, the ground-based hoist 22 can be a motor hoist 26 and the component 24 can be any component requiring positioning from below the automobile, such as, a transmission 28, a gas tank, a rear end, etc.

Overall Configuration of the Angularly Adjustable and Reversible Saddle 20

The overall configuration of the angularly adjustable and reversible saddle 20 can best be seen in FIGS. 2-8, and as such, will be discussed with reference thereto.

The angularly adjustable and reversible saddle 20 comprises a receiver 30 and a mounting apparatus 32. The receiver 30 is for replaceably supporting the component 24. The mounting apparatus 32 depends from the receiver 30, and is for replaceably, angularly adjustably, and reversibly attaching to the ground-based hoist 22 via the lateral through bore 23*b* of the free distal end 23*a* of the boom 23 of the ground-based hoist 22.

Specific Configuration of the Receiver 30

The specific configuration of the receiver 30 can best be seen in FIGS. 2-8, and as such, will be discussed with reference thereto.

The receiver 30 comprises a base plate 34.

The base plate 34 of the receiver 30 is flat, generally horizontally oriented, rectangular-shaped, and as such, has a pair of long edges 36, a pair of short edges 38, and two pair of right-angled corners 40, and has an upper surface 42, a lower surface 44, and a center 46.

The receiver 30 further comprises a pedestal 48.

The pedestal 48 of the receiver 30 is straight, generally vertically oriented, and depends, at a proximal end 50 thereof, from the lower surface 44 of the base plate 34 of the receiver 30 to, a distal end 52 thereof, at the center 46 of the base plate 34 of the receiver 30.

The receiver 30 further comprises a first pair of uprights 54.

The first pair of uprights 54 of the receiver 30 are flat, rectangular-shaped, generally vertically oriented, parallel to each other, aligned with each other, and extend perpendicularly upwardly from the upper surface 42 of the base plate 34 of the receiver 30.

The first pair of uprights 54 of the receiver 30 are disposed along the pair of long edges 36 of the base plate 34 of the receiver 30, respectively, and are flush with, but do not extend along, one short edge 38 of the base plate 34 of the receiver 30.

Each first upright 54 of the receiver 30 has a pair of lateral through bores 56. The pair of lateral through bores 56 of each first upright 54 of the receiver 30 are for replaceably receiving two hooks 58 of two bungee cords 60, respectively, (FIG. 3) that are for replaceably holding the component 24 to the base plate 34 of the receiver 30.

The receiver 30 further comprises a second pair of uprights 62.

The second pair of uprights 62 of the receiver 30 are angle iron, generally vertically oriented, aligned with each other, and extend perpendicularly upwardly from the upper surface 42 of the base plate 34 of the receiver 30.

The second pair of uprights 54 of the receiver 30 are disposed at a pair of corners 40 of the base plate 34 of the receiver 30, respectively, opposite to the first pair of uprights 54 of the receiver 30.

Each second upright 62 of the receiver 30 has a pair of lateral through bores 64. The pair of lateral through bores 64 of each second upright 62 of the receiver 30 are for replaceably receiving an additional hook 66 of an additional bungee cord 68 (FIG. 3) that is for further replaceably holding the component 24 to the base plate 34 of the receiver 30.

Specific Configuration of the Mounting Apparatus 32

The specific configuration of the mounting apparatus 32 can best be seen in FIGS. 2-11, and as such, will be discussed with reference thereto.

The mounting apparatus 32 comprises a yoke 69, and as such, has a pair of flanges 69*a* connected to each other by a web 70.

The pair of flanges 69*a* of the yoke 69 of the mounting apparatus 32 are vertically oriented, flat, parallel to each other, identical to each other, and are spaced-apart from each other by a space 72 for receiving the free distal end 23*a* of the boom 23 of the ground-based hoist 22.

The web 70 of the yoke 69 of the mounting apparatus 32 is generally horizontally oriented, flat, and perpendicular to the pair of flanges 69*a* of the yoke 69 of the mounting apparatus 32.

The pair of flanges 69*a* of the yoke 69 of the mounting apparatus 32 have a pair of lateral through bores 74, respectively.

The pair of lateral through bores 74 of the pair of flanges 69*a* of the yoke 69 of the mounting apparatus 32, respectively, are aligned with each other, and are for being aligned with the lateral through bore 23*b* of the free distal end 23*a* of the boom 23 of the ground-based hoist 22.

The mounting apparatus 32 further comprises a mounting bolt 76.

The mounting bolt 76 of the mounting apparatus 32 passes freely through the pair of lateral through bores 74 of the pair of flanges 69*a* of the yoke 69 of the mounting apparatus 32, respectively, is for passing freely through the lateral through bore 23*b* of the free distal end 23*a* of the boom 23 of the ground-based hoist 22, and receives a nut 78, and in so doing, replaceably and angularly mounts the angularly adjustable and reversible saddle 20 to the free distal end 23*a* of the boom 23 of the ground-based hoist 22.

By removing the nut 78 of the mounting apparatus 32 and subsequently the mounting bolt 76 of the mounting apparatus 32, the angularly adjustable and reversible saddle 20 can be reversed making the angularly adjustable and reversible saddle 20 reversible.

The web 70 of the yoke 69 of the mounting apparatus 32 is perpendicularly and centrally affixed to the distal end 52 of the pedestal 48 of the receiver 30.

The web 70 of the yoke 69 of the mounting apparatus 32 has a pair of through bores 80.

The pair of through bores 80 of the web 70 of the yoke 69 of the mounting apparatus 32 equally straddle the distal end 52 of the pedestal 48 of the receiver 30.

The web 70 of the yoke 69 of the mounting apparatus 32 has a pair of nuts 82.

The pair of nuts 82 of the web 70 of the yoke 69 of the mounting apparatus 32 are affixed at the pair of through bores 80 of, and from below, the web 70 of the yoke 69 of the mounting apparatus 32, respectively, so as to form the pair of through bores 80 of the web 70 of the yoke 69 of the mounting apparatus 32 into a pair of threaded through bores.

In the alternative, however, the pair of through bores 80 of the web 70 of the yoke 69 of the mounting apparatus 32 can be tapped to form the pair of threaded through bores, eliminating a need for the pair of nuts 82 of the web 70 of the yoke 69 of the mounting apparatus 32.

The mounting apparatus 32 further comprises a pair of adjusting bolts 84.

Figure 9:
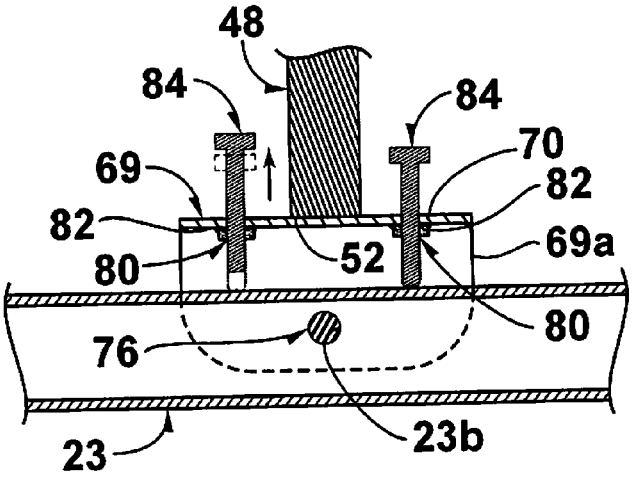
FIGS. 9, 10, and 11 are cross sectional views, taken along line 9,10,11-9,10,11 illustrating the fixture being adjusted from a horizontal position to a tilted position.
Figure 10:
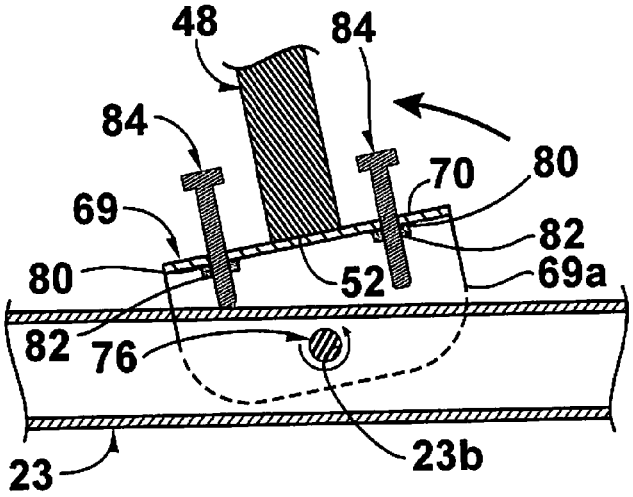
Figure 11:
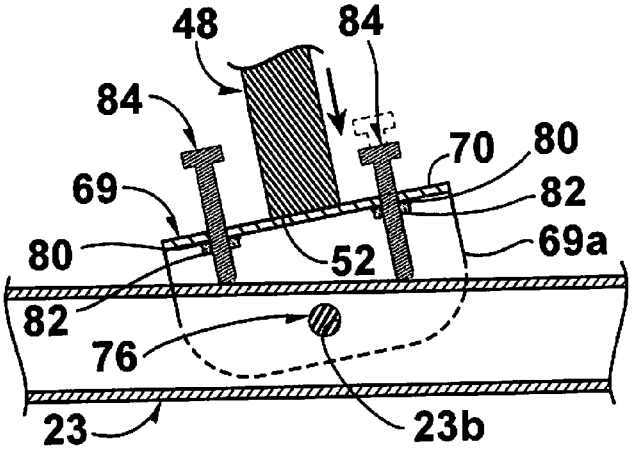

As shown in FIGS. 9-11, once the yoke 69 of the mounting apparatus 32 has been oriented by pivoting via the mounting bolt 76 of the mounting apparatus 32 so as to position the receiver 30 at a desired angle, the pair of adjusting bolts 84 of the mounting apparatus 32 are threaded relative to the pair of threaded through bores of, and from above, the web 70 of the yoke 69 of the mounting apparatus 32, respectively, until the pair of adjusting bolts 84 of the mounting apparatus 32 contact the boom 23 of the ground-based hoist 22, thereby maintaining the receiver 30 at the desired angle.

Impressions

It will be understood that each of the elements described above, or two or more together, may also find a useful application in other types of constructions differing from the types described above.

While the invention has been illustrated and described as embodiments of an adjustable fixture for holding a part on a hoist/crane, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An angularly adjustable and reversible saddle for replaceably, angularly, and reversibly attaching to a ground-based hoist including a boom having a free distal end with a lateral through bore, and for replaceably supporting a component, comprising:

a) a receiver; and b) a mounting apparatus;

wherein said receiver is for replaceably supporting the component;

wherein said mounting apparatus depends from said receiver; and wherein said mounting apparatus is for replaceably, angularly adjustably, and reversibly attaching to the ground-based hoist via the lateral through bore of the free distal end of the boom of the ground-based hoist wherein said receiver comprises a base plate;

wherein said base plate of said receiver has a center;

wherein said receiver comprises a pedestal;

wherein said pedestal of said receiver has a proximal end;

wherein said pedestal of said receiver has a distal end;

wherein said mounting apparatus comprises a yoke.

2. The angularly adjustable and reversible saddle of claim 1, wherein said base plate of said receiver is flat.

3. The angularly adjustable and reversible saddle of claim 1, wherein said base plate of said receiver is generally horizontally oriented.

4. The angularly adjustable and reversible saddle of claim 1, wherein said base plate of said receiver is rectangular-shaped.

5. The angularly adjustable and reversible saddle of claim 1, wherein said base plate of said receiver has a pair of long edges.

6. The angularly adjustable and reversible saddle of claim 5, wherein said base plate of said receiver has a pair of short edges.

7. The angularly adjustable and reversible saddle of claim 6, wherein said base plate of said receiver has two pair of right-angled corners.

8. The angularly adjustable and reversible saddle of claim 7, wherein said base plate of said receiver has an upper surface.

9. The angularly adjustable and reversible saddle of claim 8, wherein said receiver comprises a first pair of uprights.

10. The angularly adjustable and reversible saddle of claim 9, wherein said first pair of uprights of said receiver are flat.

11. The angularly adjustable and reversible saddle of claim 9, wherein said first pair of uprights of said receiver are rectangular-shaped.

12. The angularly adjustable and reversible saddle of claim 9, wherein said first pair of uprights of said receiver are generally vertically oriented.

13. The angularly adjustable and reversible saddle of claim 9, wherein said first pair of uprights of said receiver are parallel to each other.

14. The angularly adjustable and reversible saddle of claim 9, wherein said first pair of uprights of said receiver are aligned with each other.

15. The angularly adjustable and reversible saddle of claim 9, wherein said first pair of uprights of said receiver extend perpendicularly upwardly from said upper surface of said base plate of said receiver.

16. The angularly adjustable and reversible saddle of claim 9, wherein said first pair of uprights of said receiver are disposed along said pair of long edges of said base plate of said receiver, respectively.

17. The angularly adjustable and reversible saddle of claim 9, wherein said first pair of uprights of said receiver are flush with one short edge of said base plate of said receiver.

18. The angularly adjustable and reversible saddle of claim 17, wherein said first pair of uprights of said receiver do not extend along said one short edge of said base plate of said receiver.

19. The angularly adjustable and reversible saddle of claim 9, wherein each first upright of said receiver has a pair of lateral through bores;

wherein said pair of lateral through bores of each first upright of said receiver are for replaceably receiving two hooks of two bungee cords, respectively; and wherein the two bungee cords are for replaceably holding the component to said base plate of said receiver.

20. The angularly adjustable and reversible saddle of claim 19, wherein said receiver comprises a second pair of uprights.

21. The angularly adjustable and reversible saddle of claim 20, wherein said second pair of uprights of said receiver are angle iron.

22. The angularly adjustable and reversible saddle of claim 20, wherein said second pair of uprights of said receiver are generally vertically oriented.

23. The angularly adjustable and reversible saddle of claim 20, wherein said second pair of uprights of said receiver are aligned with each other.

24. The angularly adjustable and reversible saddle of claim 20, wherein said second pair of uprights of said receiver extend perpendicularly upwardly from said upper surface of said base plate of said receiver.

25. The angularly adjustable and reversible saddle of claim 20, wherein said second pair of uprights of said receiver are disposed at a pair of corners of said base plate of said receiver, respectively.

26. The angularly adjustable and reversible saddle of claim 20, wherein said second pair of uprights of said receiver are disposed opposite to said first pair of uprights of said receiver.

27. The angularly adjustable and reversible saddle of claim 20, wherein each second upright of said receiver has a pair of lateral through bores;

wherein said pair of lateral through bores of each second upright of said receiver are for replaceably receiving an additional hook of an additional bungee cord; and wherein the additional bungee cord is for further replaceably holding the component to said base plate of said receiver.

28. The angularly adjustable and reversible saddle of claim 1, wherein said base plate of said receiver has a lower surface.

29. The angularly adjustable and reversible saddle of claim 1, wherein said pedestal of said receiver is straight.

30. The angularly adjustable and reversible saddle of claim 1, wherein said pedestal of said receiver is generally vertically oriented.

31. The angularly adjustable and reversible saddle of claim 1, wherein said pedestal of said receiver depends, at said proximal end thereof, from a lower surface of said base plate of said receiver to said distal end thereof.

32. The angularly adjustable and reversible saddle of claim 1, wherein said pedestal of said receiver depends from said center of said base plate of said receiver.

33. The angularly adjustable and reversible saddle of claim 1, wherein said yoke of said mounting apparatus has a pair of flanges connected to each other by a web.

34. The angularly adjustable and reversible saddle of claim 33, wherein said pair of flanges of said yoke of said mounting apparatus are vertically oriented.

35. The angularly adjustable and reversible saddle of claim 33, wherein said pair of flanges of said yoke of said mounting apparatus are flat.

36. The angularly adjustable and reversible saddle of claim 33, wherein said pair of flanges of said yoke of said mounting apparatus are parallel to each other.

37. The angularly adjustable and reversible saddle of claim 33, wherein said pair of flanges of said yoke of said mounting apparatus are spaced-apart from each other by a space; and wherein said space of said yoke is for replaceably receiving the free distal end of the boom of the ground-based hoist.

38. The angularly adjustable and reversible saddle of claim 33, wherein said web of said yoke of said mounting apparatus is generally horizontally oriented.

39. The angularly adjustable and reversible saddle of claim 33, wherein said web of said yoke of said mounting apparatus is flat.

40. The angularly adjustable and reversible saddle of claim 33, wherein said web of said yoke of said mounting apparatus is perpendicular to said pair of flanges of said yoke of said mounting apparatus.

41. The angularly adjustable and reversible saddle of claim 33, wherein said pair of flanges of said yoke of said mounting apparatus have a pair of lateral through bores; and wherein said pair of lateral through bores of said pair of flanges of said yoke of said mounting apparatus, respectively, are for being aligned with the lateral through bore of the free distal end of the boom of the ground-based hoist.

42. The angularly adjustable and reversible saddle of claim 41, wherein said pair of lateral through bores of said pair of flanges of said yoke of said mounting apparatus are aligned with each other.

43. The angularly adjustable and reversible saddle of claim 41, wherein said mounting apparatus comprises a mounting bolt.

44. The angularly adjustable and reversible saddle of claim 43, wherein said mounting bolt of said mounting apparatus passes freely through said pair of lateral through bores of said pair of flanges of said yoke of said mounting apparatus, is for passing freely through said lateral through bore of said free distal end of said boom of said ground-based hoist, and receives a nut, and in so doing, replaceably and angularly mounts said angularly adjustable and reversible saddle to the free distal end of the boom of the ground-based hoist.

45. The angularly adjustable and reversible saddle of claim 43, wherein said web of said yoke of said mounting apparatus has a pair of through bores.

46. The angularly adjustable and reversible saddle of claim 45, wherein said pair of through bores of said web of said yoke of said mounting apparatus straddle said distal end of said pedestal of said receiver.

47. The angularly adjustable and reversible saddle of claim 45, wherein said pair of through bores of said web of said yoke of said mounting apparatus equally straddle said distal end of said pedestal of said receiver.

48. The angularly adjustable and reversible saddle of claim 45, wherein said web of said yoke of said mounting apparatus has a pair of nuts.

49. The angularly adjustable and reversible saddle of claim 48, wherein said pair of nuts of said web of said yoke of said mounting apparatus are affixed at said pair of through bores of said web of said yoke of said mounting apparatus, respectively, so as to form said pair of through bores of said web of said yoke of said mounting apparatus into a pair of threaded through bores.

50. The angularly adjustable and reversible saddle of claim 48, wherein said pair of nuts of said web of said yoke of said mounting apparatus are affixed at said pair of through bores from below said web of said yoke of said mounting apparatus, respectively.

51. The angularly adjustable and reversible saddle of claim 45, wherein said pair of through bores of said web of said yoke of said mounting apparatus are tapped to form a pair of threaded through bores.

52. The angularly adjustable and reversible saddle of claim 49 or 51, wherein said mounting apparatus comprises a pair of adjusting bolts.

53. The angularly adjustable and reversible saddle of claim 52, wherein once said mounting apparatus has been oriented by pivoting via said mounting bolt of said mounting apparatus so as to position said receiver at a desired angle, said pair of adjusting bolts of said mounting apparatus are threaded relative to said pair of threaded through bores of, and from above, said web of said yoke of said mounting apparatus, respectively, until said pair of adjusting bolts of said mounting apparatus contact the boom of the ground-based hoist, thereby maintaining said receiver at said desired angle.

54. The angularly adjustable and reversible saddle of claim 33, wherein said web of said yoke of said mounting apparatus is perpendicularly affixed to said distal end of said pedestal of said receiver.

55. The angularly adjustable and reversible saddle of claim 33, wherein said web of said yoke of said mounting apparatus is centrally affixed to said distal end of said pedestal of said receiver.

* * * * *